United States Patent [19]

Campbell

[11] Patent Number: 4,944,394

[45] Date of Patent: Jul. 31, 1990

[54] CIGARETTE CARTON INSERT

[75] Inventor: Christopher J. Campbell, Midlothian, Va.

[73] Assignee: Philip Morris Incorporated, New York, N.Y.

[21] Appl. No.: 205,120

[22] Filed: Jun. 10, 1988

[51] Int. Cl.[5] ..... B65D 5/48

[52] U.S. Cl. ..... 206/256; 206/273; 220/418; 220/441; 229/167

[58] Field of Search ..... 206/256, 273, 521, 583, 206/594; 220/416, 418, 441, 443, 469; 229/167, DIG. 2, DIG. 4, 23 R, 23 A

[56] References Cited

U.S. PATENT DOCUMENTS

| | | | |
|---|---|---|---|
| 987,958 | 3/1911 | Clenny et al. | 220/416 |
| 1,121,232 | 12/1914 | Davis . | |
| 1,224,996 | 5/1917 | Baldwin . | |
| 1,238,364 | 8/1917 | Wallace | 229/23 R |
| 1,550,646 | 8/1925 | Larson | 220/416 |
| 1,691,736 | 11/1928 | Oppenheim | 206/594 |
| 1,735,082 | 11/1929 | Martin, Jr. | 220/441 |
| 1,870,299 | 8/1932 | Strelitz . | |
| 2,158,971 | 5/1939 | Stratton . | |
| 2,176,284 | 10/1939 | Whiteford . | |
| 2,625,315 | 1/1953 | Fehrenkamp | 229/DIG. 4 |
| 2,766,921 | 10/1956 | Jones et al. | 229/23 R |
| 2,783,929 | 3/1957 | Delaney . | |
| 2,803,391 | 8/1957 | Koeble . | |
| 3,223,311 | 12/1965 | Becker et al. . | |
| 3,489,272 | 1/1970 | Rosen . | |
| 3,536,246 | 10/1970 | Rosen . | |
| 3,554,431 | 1/1971 | Lock . | |
| 3,580,470 | 5/1971 | Leonard . | |
| 3,596,758 | 8/1971 | Phillips et al. . | |
| 3,721,335 | 3/1973 | Grant . | |
| 3,752,308 | 8/1973 | Begemann . | |
| 3,892,346 | 7/1975 | Hughes et al. . | |
| 4,738,359 | 4/1988 | Phillips | 206/256 |
| 4,773,531 | 9/1988 | Tudor et al. | 206/256 |
| 4,815,592 | 3/1989 | Kunkel | 206/264 |

FOREIGN PATENT DOCUMENTS

| | | | |
|---|---|---|---|
| 1204058 | 9/1970 | United Kingdom | 220/441 |

*Primary Examiner*—Stephen Marcus

*Attorney, Agent, or Firm*—Mark H. Bloomberg; Doreen F. Shulman

[57] ABSTRACT

A paperboard insert for cigarette cartons is provided to restrict the lateral movement of smaller size cigarette packages contained in a standard size cigarette carton to enable the packages to be reliably stamped by standard tax marking machinery. The insert blank has a bottom, sides for abutting cigarette packages, spacers to position the insert sides inwardly of the carton walls and generally centered along the longitudinal axis of the carton, and attachment tabs to connect the insert to the carton walls. The insert blank may be attached to a standard carton blank prior to erection of the carton, allowing the insert to be erected simultaneously with the carton as a consequence of ordinary carton erection procedures.

22 Claims, 3 Drawing Sheets

FIG. 4
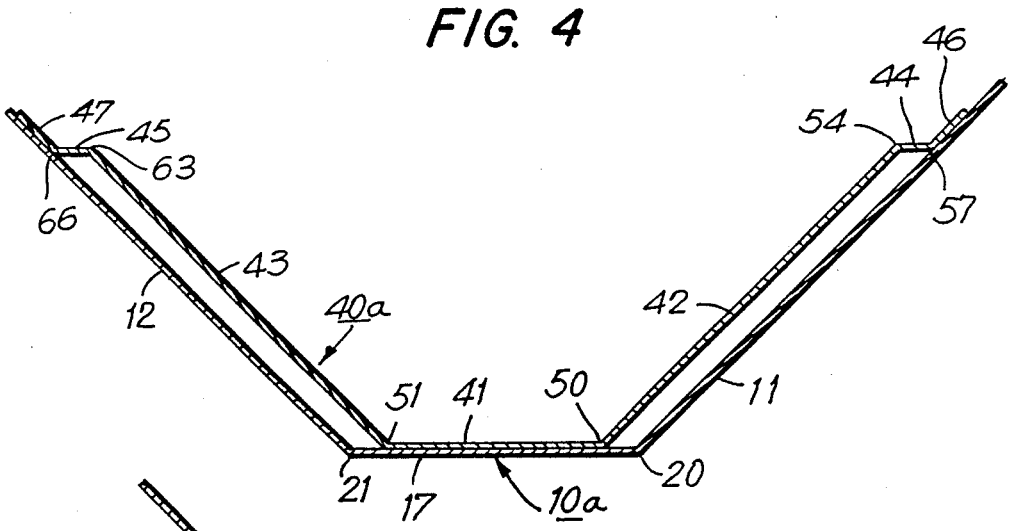
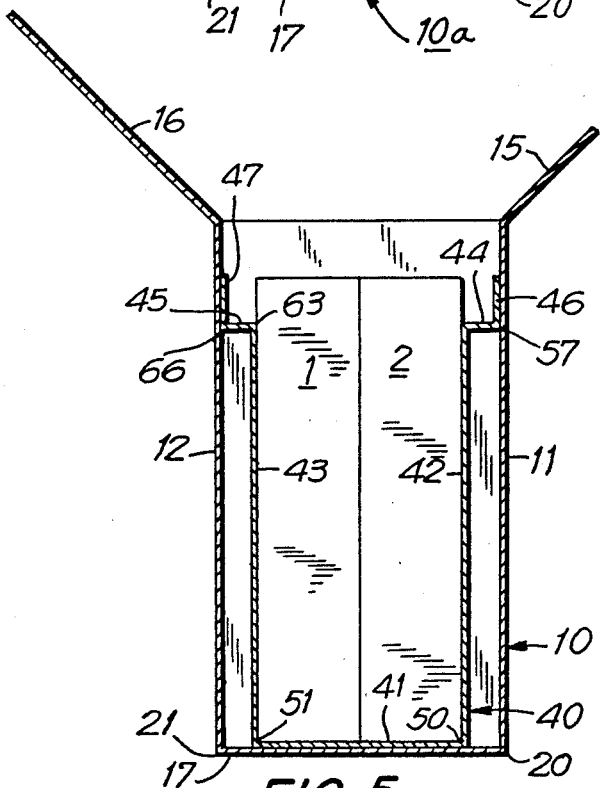
FIG. 5

CIGARETTE CARTON INSERT

BACKGROUND OF THE INVENTION

This invention relates to cigarette cartons, and particularly to an insert blank to reduce the lateral internal space within a carton. The insert blank may be attached to a carton blank and erected simultaneously with the carton blank by folding the carton blank by ordinary procedures, or separately erected and attached to a fully erected carton. As used herein, the term cigarette carton means a folded container of paperboard or the like used to hold a plurality, normally ten, of cigarette packages.

In the past, cigarettes have generally been made with standard circumferences of about 25 millimeters. More recently, thinner cigarettes of about 19 millimeters or less have increased in popularity due to changing consumer demand. When smaller circumference cigarettes are packaged in the usual quantity of twenty, the resulting package is smaller than a package of twenty standard size cigarettes. For example, a package containing two rows of ten smaller size cigarettes will have approximately the same width as a package containing twenty standard size cigarettes in the usual 7-6-7 configuration, but its thickness will be substantially less. If ten such packages of smaller size cigarettes are placed in a standard size cigarette carton in the usual five-by-two array, they will not occupy all of the lateral space within the carton. Hence, these smaller packages will move within the carton as the carton is transported and handled.

Such movement is undesirable because tax stamps, required by state laws, may not be properly applied to the cigarette packages in their altered lateral positions. Conventional tax marking machinery is designed to apply a tax stamp to each of the ten packages contained in the carton based on the packages being located at known positions within the carton. Virtually all tax marking machinery is designed to operate with standard size cartons in which each of the ten standard size packages is restrained to a fixed location within the relatively close-fitting carton. Although some movement of cigarette packages within the carton is acceptable, increasing lateral separation between the packages and the carton side walls, or between the paired packages, as the cigarette circumference decreases may result in unsatisfactory stamping reliability.

Although this problem could be solved by using smaller size cartons and new or modified tax marking machinery designed to operate on smaller size cartons, it is advantageous to continue to use standard carton dimensions and machinery. Hence, a means is required to restrict the lateral movement of smaller size packages placed in a standard size carton. Additionally, it is desirable to use the same carton blanks used with standard size cigarette packages and to erect cartons from those blanks by the same process, regardless of cigarette package size.

SUMMARY OF THE INVENTION

It is an object of this invention to provide an insert for a standard size cigarette carton that will laterally position smaller than standard size cigarette packages within a standard size cigarette carton to be tax stamped by equipment designed to operate on standard size cigarette packages contained in a standard size cigarette carton.

It is a further object of this invention to provide an insert blank that may be attached to a standard carton blank prior to erection of the carton to enable the carton to be erected together with the insert by the same process used to erect an ordinary carton for standard size cigarettes.

In accordance with the invention, an insert blank is provided having a bottom, front and rear sides to abut smaller size cigarette packages, front and rear spacers to separate the insert sides the desired distance from the carton sides, and front and rear attachment tabs to connect the insert blank to the carton bank. These sections of the insert blank are separated by score lines, which may be scored or perforated, in such a manner that the insert, which may also be attached to the carton blank at its bottom, can be erected within the carton at the same time that the carton is erected by the usual process of folding along the various score lines of the carton blank. The reduced lateral dimension provided by the insert Within the standard size carton approximately corresponds to the thickness of a pair of smaller size cigarette packages, thereby virtually eliminating lateral movement of such packages within the carton, and enabling smaller size packages contained in and generally centered along the longitudinal axis of a standard carton to be stamped by standard tax marking machinery with acceptable reliability.

BRIEF DESCRIPTION OF THE DRAWINGS

The above and other objects and advantages of the invention will be apparent from consideration of the following detailed description, taken in conjunction with the accompanying drawings, in which like reference characters refer to like parts throughout, and in which:

FIG. 4 is a sectional view of a partially erected insert and carton depicted in FIG. 1, with sections corresponding to the top and ends of the carton deleted;, and FIG. 5 is a sectional view of a fully erected carton with insert, taken along the line 5—5 of FIG. 1.

DETAILED DESCRIPTION OF THE INVENTION

Figure 1:
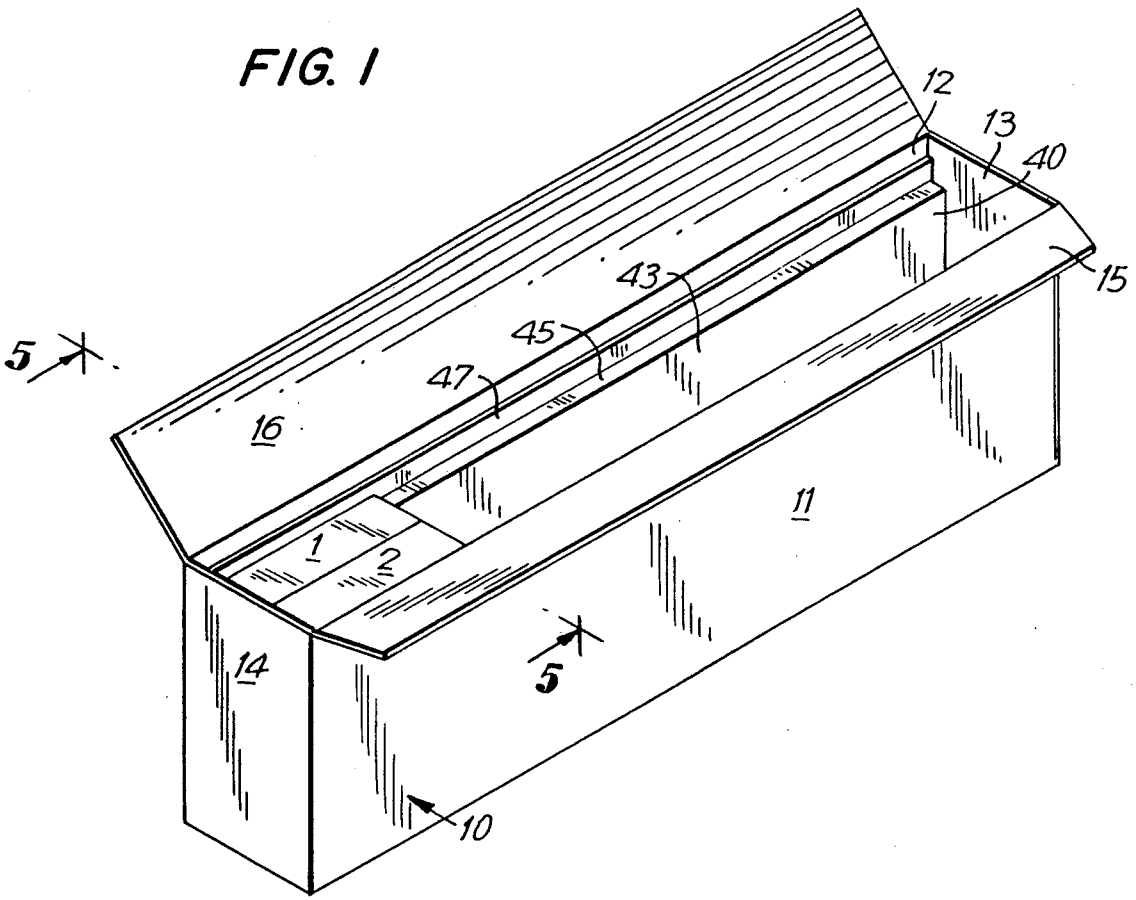
FIG. 1 is a perspective view of a standard size cigarette carton containing an insert in accordance with the invention, and one of the usual five pairs of smaller size packages of cigarettes, the carton being shown in open condition as it would be preliminary to tax marking of the cigarette packages.

Fully erected cigarette carton 10 is shown in FIG. 1 together with fully erected insert 40 and one of the usual five pairs of smaller size cigarette packages 1 and 2. Opposing front carton wall panel 11 and rear carton wall panel 12 extend in the longitudinal direction between opposing right end wall 13 and left end wall 14, defining the interior space of carton 10. The interior lateral dimension of carton 10 is the distance between front carton wall 11 and rear carton wall 12. For simplicity, the carton top wall structure, which is well known in the art, is shown generally as front flap 15 and rear flap 16.

Smaller size cigarette packages 1 and 2 are shown inside carton 10, generally centered along the longitudinal axis of carton 10, in the desired position for tax marking. As can been seen more clearly in FIG. 5, the combined lateral dimension of packages 1 and 2 is less than the interior lateral dimension of carton 10 so that lateral movement of packages 1 and 2 would be permitted in the absence of longitudinally extending front insert wall 42 and rear insert wall 43, located laterally inward of carton walls 11 and 12. Insert walls 42 and 43 need not extend the full longitudinal length of carton walls 11 and 12, but it is preferred that insert walls 42 and 43 and carton walls 11 and 12 be substantially the same in length. The separation between insert walls 42 and 43 is defined at their bottoms by the lateral dimension of insert bottom 41, and at their tops by the separation between the innermost parts of front spacer 44 and rear spacer 45. Insert walls 42 and 43 may be vertical when fully erected, in which event the dimension of insert bottom 41 is equal to the separation between spacers 44 and 45. Insert walls 42 and 43 abut the front and rear sides of each of the five pairs of packages 1 and 2 to maintain the desired lateral position of packages 1 and 2 within carton 10, allowing each pair of packages 1 and 2 to be properly marked with required tax stamps. The tax marking process and machinery used therefor are well known in the art, and are not described herein.

Figure 2:
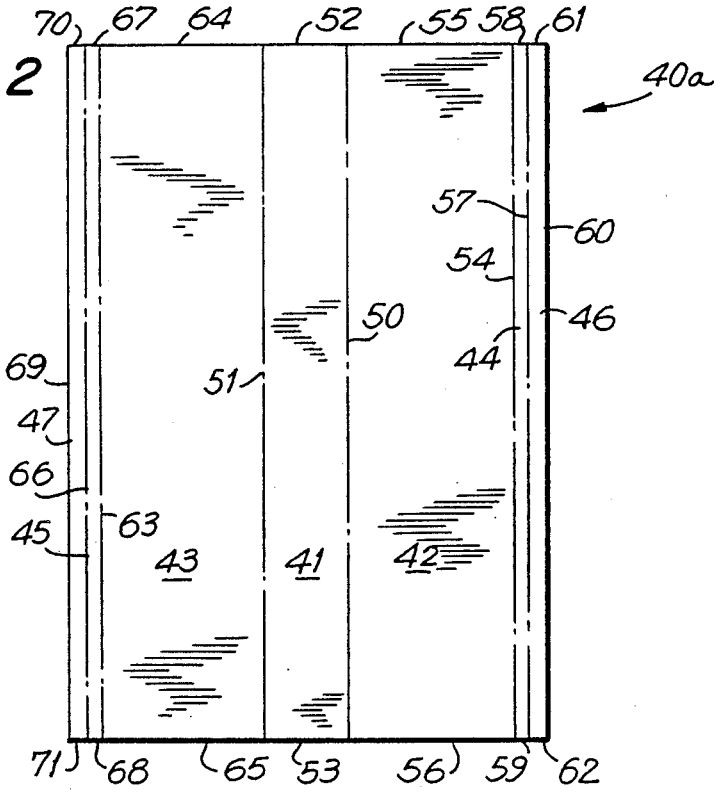
FIG. 2 is a plan view of the insert blank depicted in FIG. 1 in its unerected state.

Insert 40 is preferably erected from paperboard insert blank **40*a*, which has seven panel sections: insert bottom 41, front insert wall 42, rear insert wall 43, front spacer 44, rear spacer 45, front attachment tab 46 and rear attachment tab 47. The preferred embodiment of insert blank 40*a* is shown in FIG. 2 prior to erection. In plan view, blank 40*a*** may be rectangular in shape.

Insert bottom 41 is defined in the lateral direction by the separation between parallel insert bottom front score line 50 and insert bottom rear score line 51. It will be recognized that score lines 50 and 51, as well as all other score lines employed in my invention, may equivalently be scored or perforated. The distance between lines 50 and 51 is less than the distance between carton walls 11 and 12, and may be as small as the combined lateral dimension of packages 1 and 2, but should be substantially equal to that dimension, enabling insert walls 42 and 43 to be substantially vertical and to abut packages 1 and 2 when insert 40 is erected. Insert bottom 41 is defined in the longitudinal direction by insert bottom right side 52 and insert bottom left side 53 which connect lines 50 and 51. It will be recognized that sides 52 and 53 need not be straight, but it is preferred that sides 52 and 53 be straight lines, parallel to each other and perpendicular to lines 50 and 51.

Front insert wall 42 extends from insert bottom 41 at insert bottom front score line 50 to front top score line 54. Front wall 42 is defined in the longitudinal direction by insert front right side 55 and insert front left side 56. Similarly, rear insert wall 43 extends from insert bottom 41 at insert bottom rear score line 51 to rear top score line 63 and is defined in the longitudinal direction by insert rear right side 64 and insert rear left side 65. Top line 54 becomes the top of front wall 42 and rear line 63 becomes the top of rear wall 43 when insert 40 is erected. Lines 54 and 63 may be scored or perforated, but should be straight. Line 54 need not be parallel to line 50 and line 63 need not be parallel to 51, although it is preferred that insert blank **40*a* be made with lines 54 and 63 parallel to lines 50 and 51. It will be recognized that wall 42 will vary in height when insert 40 is erected if line 54 is not parallel to line 50 and that wall 43 will vary in height if line 63 is not parallel to line 51. Sides 55, 56, 64 and 65 need not be straight, but, as can be seen from FIG. 2, it is preferred that right sides 55 and 64 be straight and colinear with insert bottom right side 52, and that left sides 56 and 65 be straight and colinear with insert bottom left side 53. Also, it is preferred that lines 55, 56, 64, and 65 be equal in length, so that front wall 42 has the same height as rear wall 43 when insert 40 is erected. The height of walls 42 and 43 is preferably approximately two-thirds the height of packages 1 and 2**.

Front spacer 44 extends from front wall 42 at front top score line 54 to front spacer score line 57. Front spacer 44 is defined in the longitudinal direction by right front spacer side 58 and left front spacer side 59. When insert 40 is fully erected, front spacer 44 abuts front wall 11 of carton 10 at line 57 so that front spacer 44 separates front insert wall 42 from front carton wall 11. Similarly, rear spacer 45 extends from rear wall 43 at rear top score line 63 to rear spacer score line 66. Rear spacer 45 is defined in the longitudinal direction by right rear spacer side 67 and left rear spacer side 68. Rear spacer score line 66 abuts rear wall 12 of carton 10 when insert 40 is fully erected so that rear spacer 45 separates rear insert wall 43 from rear carton wall 12. Front spacer score line 57 should be straight and parallel to top score line 54 and rear spacer score line 66 should be straight and parallel to top score line 63 so that the widths of spacers 44 and 45 will be constant along the lengths of lines 57 and 66, maintaining a constant separation between the tops of insert walls 42 and 43 and respective carton walls 11 and 12. Sides 58, 59, 67 and 68 need not be straight, but as can be seen from FIG. 2, it is preferred that right sides 58 and 67 be straight and colinear with side 52, and that left sides 59 and 68 be straight and colinear with side 53. Further, it is preferred that sides 58, 59, 67 and 68 have a common length so that spacers 44 and 45 separate insert walls 42 and 43 from carton walls 11 and 12 substantially equally, thereby laterally centering insert 40, and, hence, packages 1 and 2, inside of carton 10 along the longitudinal axis of carton 10.

Front attachment tab 46 extends from front spacer 44 at front spacer score line 57 to front attachment tab end 60, and is defined in the longitudinal direction by front attachment tab right side 61 and front attachment tab left side 62. End 60 and sides 61 and 62 need not be straight, but it is preferred that side 61 be straight and colinear with side 58, that side 62 be straight and colinear with side 59, and that end 60 be straight and perpendicular to sides 61 and 62. Rear attachment tab 47 extends from rear spacer 45 at rear spacer score line 66 to rear attachment tab end 69, and is defined in the longitudinal direction by rear attachment tab right side 70 and rear attachment tab left side 71. End 69 and sides 70 and 71 need not be straight, but it is preferred that side 70 be straight and colinear with side 67, that side 71 be straight and colinear with side 68, and that end 69 be straight and perpendicular to sides 70 and 71. It is further preferred that sides 61, 62, 70 and 71 have equal length so that front tab 46 has the same dimension as rear tab 47. Front attachment tab 46 abuts front side 11 of carton 10 and may be attached to side 11 of carton blank **10*a* prior to erection, preferably by a water-based adhesive, and rear attachment tab 47 abuts rear side 12 of carton 10 and may be attached to side 12 of carton blank 10***a* prior to erection, also preferably by a water-based adhesive.

From the foregoing, it should be apparent that insert blank 40*a* preferably be rectangular in shape prior to folding and that the dimensions of front wall 42, front spacer 44 and front attachment tab 46 be equal, respectively, to the dimensions of rear wall 43, rear spacer 45 and rear attachment tab 47.

The construction and erection of cigarette cartons from paperboard blanks is well known in the art. Those portions of typical carton blank 10*a* that relate to my invention are shown prior to erection in FIG. 3. Carton bottom 17 has lateral dimension defined by the separation between carton bottom front score line 20 and parallel carton bottom rear score line 21. The longitudinal dimension of bottom 17 is defined by carton bottom right side 22 and carton bottom left side 23, which may be score lines separating portions of right and left end walls 13 and 14 from carton bottom 17. Front carton wall panel 11 extends from carton bottom front score line 20, and has height when vertically erected equal to the separation between bottom front score line 20 and parallel front top line 24, and longitudinal dimension equal to the separation between right carton front side 25 and left carton front side 26. Rear carton wall panel 12 extends from carton bottom rear score line 21, and has height when vertically erected equal to the separation between bottom rear score line 21 and parallel rear top line 27, and longitudinal dimension equal to the separation between right carton rear side 28 and left carton rear side 29.

Carton bottom score lines 20 and 21 may be scored or perforated. Top lines 24 and 27, carton front sides 25 and 26, and carton rear sides 28 and 29 may be score lines separating portions of right and left end walls 13 and 14 or the top wall structure of typical carton 10. For example, as shown in FIG. 1, front fap 15 extends from front wall 11 along top line 24, and rear flap 16 extends from rear wall 12 along top line 27. The top and end wall structure of carton blank 10*a* is well known in the art, and a detailed discussion of those structures is not necessary to understand my invention.

Figure 3:
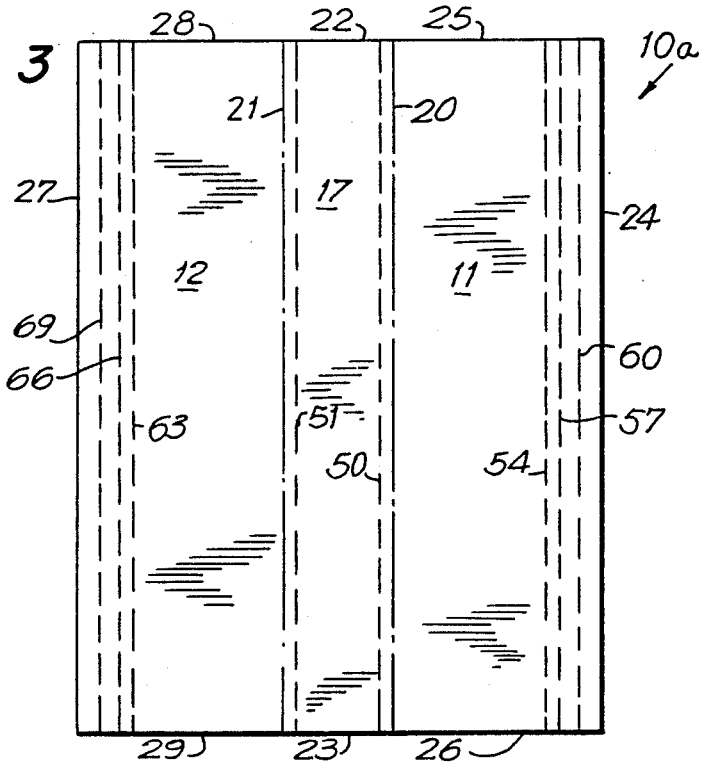
FIG. 3 is a plan view of the carton blank depicted in FIG. 1 in its unerected state, with sections corresponding to the top and ends of the carton deleted.

The simultaneous erection of insert 40 and carton 10 in accordance with the invention from insert blank 40*a* and carton blank 10*a* is shown in FIGS. 3-5. Preferably, both insert blank 40*a* and carton blank 10*a* are made of SBS paperboard material. Lines 50, 51, 54, 57, 60, 63, 66 and 69 of insert blank 40*a* are shown in FIG. 3 in their preferred locations relative to carton blank 10*a* prior to erection of insert 40 and carton 10. Insert lines 50, 51, 54, 57, 60, 63, 66 and 69 are parallel to carton lines 20, 21, 24 and 27. The preferred separation between lines 50 and 20 is equal to the separation between lines 51 and 21, although equal separation is not required. Also, the preferred separation between lines 66 and 63 is equal to the separation between lines 51 and 21, and the preferred separation between lines 57 and 54 is equal to the separation between lines 50 and 20. The above mentioned preferred separations will produce the final orientation of insert 40 as shown in FIG. 5, with vertical front and rear insert walls 42 and 43 of equal height, and packages 1 and 2 centrally positioned between front and rear walls 11 and 12 of carton 10.

Prior to simultaneously erecting insert 40 and carton 10, the surface of front attachment tab 46 is attached to the abutting surface of front carton wall 11, and the surface of rear attachment tab 47 is attached to the abutting surface of rear carton wall 12. Insert bottom 41 may also be attached to carton bottom 17. It is preferred that tabs 46 and 47 and bottom 41 each be attached by a water-based adhesive to the aforementioned parts of carton blank 10*a*. It will be recognized that either or both of attachment tabs 46 and 47 may alternatively be bent back prior to attachment to carton blank 10*a* such that the upper surfaces of tabs 46 and 47 as shown in FIG. 3 abut carton blank 10*a*.

Carton 10 and insert 40 may be simultaneously erected by folding along carton bottom score lines 20 and 21 until carton walls 11 and 12 are vertical and perpendicular to carton bottom 17. As carton blank 10*a* is folded in this manner, attached insert blank 40*a* is folded about lines 50, 51, 54, 57, 63 and 66 to its fully erected position. FIG. 4 shows partially erected carton 10 and insert 40, and FIG. 5 shows completely erected carton 10 and insert 40. During the erection of carton 10, insert walls 42 and 43 pivot about insert bottom score lines 50 and 51 to substantially vertical positions. At the same time, spacers 44 and 45 fold about their respective spacer score lines 57 and 66 and top score lines 54 and 63, separating the tops of insert walls 42 and 43 from the points of attachment of tabs 46 and 47 to carton walls 11 and 12 at spacer score lines 57 and 66.

It will be recognized that insert 40 can be erected separately from carton 10, and placed in carton 10 fully erected prior to attachment of tabs 46 and 47 to carton walls 11 and 12. It is preferred, however, that insert blank 40*a* be attached to carton blank 10*a* prior to erection of carton 10.

It will be apparent to those skilled in the art that the invention described herein can be practiced by other than the embodiments disclosed herein, which are presented for the purposes of illustration and not of limitation, and the present invention is limited only by the claims that follow.

What is claimed is:

1. A blank for forming an insert for attachment to a standard size cigarette carton for laterally positioning smaller than standard size cigarette packages within a standard size cigarette carton for stamping by tax marking machines designed for use with standard size cigarette packages contained in standard size cigarette cartons, said blank comprising:

a bottom panel defined by a front score line, a rear score line parallel to said front score line, and first and second sides transverse of said front and rear score lines;

a front wall panel connected to said bottom panel at said front score line, and further defined by a front top score line, and first and second sides transverse of said front and front top score lines;

a front spacer connected to said front wall panel at said front top score line, and further defined by a front spacer score line parallel to said front top score line, and first and second sides transverse of said front top and front spacer score lines;

a front attachment tab connected to said front spacer at said front spacer score line, and further defined by a front margin and first and second sides transverse of said front spacer score line and said front margin;

a rear wall panel connected to said bottom panel at said rear score line, and further defined by a rear top score line, and first and second sides transverse of said rear and rear top score lines;

a rear spacer connected to said rear wall panel at said rear top score line, and further defined by a rear spacer score line parallel to said rear top score line, and first and second sides transverse of said rear top and rear spacer score lines; and a rear attachment tab connected to said rear spacer at said rear spacer score line, and further defined by a rear margin and first and second sides transverse of said rear spacer score line and said rear margin.

2. The blank of claim 1 wherein said front score line, said front top score line, said front spacer score line, said rear score line, said rear top score line, and said rear spacer score line are perforated.

3. The blank of claim 1 wherein said front margin is substantially linear and parallel to said front spacer score line and said rear margin is substantially linear and parallel to said rear spacer score line.

4. The blank of claim 1 wherein said front top score line is parallel to said front score line and said rear top score line is parallel to said rear score line.

5. The blank of claim 4 wherein said front and rear top score lines are equidistant from a line parallel to and equidistant from said front and rear score lines, and said front and rear spacer score lines are equidistant from a line parallel to and equidistant from said front and rear score lines.

6. The blank of claim 5 wherein said first sides are colinear, and perpendicular to said front score line, and said second sides are colinear, and perpendicular to said front score line.

7. The blank of claim 6 wherein said blank is rectangular in shape

8. In an erected cigarette carton having parts thereof defining a carton bottom panel, opposing front and rear carton wall panels, a top wall structure and right and left end wall structures;

said carton bottom panel defined by a carton bottom front score line, a carton bottom rear score line parallel to said carton bottom front score line, and first and second carton bottom sides transverse of said carton bottom front and rear score lines;

said front carton wall panel connected to said carton bottom front score line, and further defined by a front top margin parallel to said carton bottom front score line and first and second carton front sides transverse of said carton bottom front score line and said front top margin; and said rear carton wall panel connected to said carton bottom rear score line, and further defined by a rear top margin parallel to said carton bottom rear score line and first and second carton rear sides transverse of said carton bottom rear score line and said rear top margin, the combination with said carton of an insert having parts thereof defining an insert bottom panel, opposing front and rear insert wall panels, front and rear spacers, and front and rear attachment tabs;

said insert bottom panel defined by an insert bottom front score line, an insert bottom rear score line parallel to said insert bottom front score line, and first and second insert bottom sides transverse of said insert bottom front and rear score lines;

said front insert wall panel connected to said insert bottom panel at said insert bottom front score line, and further defined by a front top score line, and first and second insert front sides transverse of said insert bottom front score line and said front top score line;

said front spacer connected to said front insert wall panel at said front top score line, and further defined by a front spacer score line parallel to said front top score line, and first and second front spacer sides transverse of said front top score line and said front spacer score line;

said front attachment tab connected to said front spacer at said front spacer score line, and further defined by a front margin and first and second front attachment tab sides transverse of said front spacer score line and said front margin;

said rear insert wall panel connected to said insert bottom panel at said insert bottom rear score line, and further defined by a rear top score line, and first and second insert rear sides transverse of said insert bottom rear score line and said rear top score line;

said rear spacer connected to said rear insert wall panel at said rear top score line, and further defined by a rear spacer score line parallel to said rear top score line, and first and second rear spacer sides transverse of said rear top score line and said rear spacer score line; and said rear attachment tab connected to said rear spacer at said rear spacer score line, and further defined by a rear margin and first and second rear attachment tab sides transverse of said rear spacer score line and said rear margin, wherein the separation between said insert bottom front and rear score lines is less than the separation between said carton bottom front and rear score lines, and said front and rear attachment tabs are attached, respectively, to said front and rear carton walls.

9. The combination of the carton and insert of claim 8 wherein said insert bottom front and rear score lines, said front and rear top score lines, and said front and rear spacer score lines are perforated.

10. The combination of the carton and insert of claim 8 wherein said front and rear attachment tabs are adhesively attached, respectively, to said front and rear carton wall panels.

11. The combination of the carton and insert of claim 9 wherein said insert bottom panel is adhesively attached to said carton bottom panel.

12. The combination of the carton and insert of claim 8 wherein said insert bottom front and rear score lines are parallel to and equidistant, respectively, from said carton bottom front and rear score lines.

13. In a cigarette carton blank having parts thereof defining a carton bottom panel, opposing front and rear carton wall panels, top wall elements and right and left end wall elements;

said carton bottom panel defined by a carton bottom front score line, a carton bottom rear score line parallel to said carton bottom front score line, and first and second carton bottom sides transverse of said carton bottom front and rear score lines;

said front carton wall panel connected to said carton bottom front score line, and further defined by a front top margin parallel to said carton bottom front score line and first and second carton front sides transverse of said carton bottom front score line and said front top margin; and said rear carton wall panel connected to said carton bottom rear score line, and further defined by a rear top margin parallel to said carton bottom rear score line and first and second carton rear sides transverse of said carton bottom rear score line and said rear top margin, the combination with said carton blank of an insert blank having parts thereof defining an insert bottom panel, opposing front and rear insert wall panels, front and rear spacers, and front and rear attachment tabs;

said insert bottom panel defined by an insert bottom front score line, an insert bottom rear score line parallel to said insert bottom front score line, and first and second insert bottom sides transverse of said insert bottom front and rear score lines;

said front insert wall panel connected to said insert bottom panel at said insert bottom front score line, and further defined by a front top score line, and first and second insert front sides transverse of said insert bottom front score line and said front top score line;

said front spacer connected to said front insert wall panel at said front top score line, and further defined by a front spacer score line parallel to said front top score line, and first and second front spacer sides tranverse of said front top score line and said front spacer score line;

said front attachment tab connected to said front spacer at said front spacer score line, and further defined by a front margin and first and second front attachment tab sides transverse of said front spacer score line and said front margin;

said rear insert wall panel connected to said insert bottom panel at said insert bottom rear score line, and further defined by a rear top score line, and first and second insert rear sides transverse of said insert bottom rear score line and said rear top score line;

said rear spacer connected to said rear insert wall panel at said rear top score line, and further defined by a rear spacer score line parallel to said rear top score line, and first and second rear spacer sides transverse of said rear top score line and said rear spacer score line; and said rear attachment tab connected to said rear spacer at said rear spacer score line, and further defined by a rear margin and first and second rear attachment tab sides transverse of said rear spacer score line and said rear margin, wherein the separation between said insert bottom front and rear score lines is less than the separation between said carton bottom front and rear score lines, and said front and rear attachment tabs are attached, respectively, to said front and rear carton wall panels.

14. The combination of the carton blank and the insert blank of claim 13 wherein said front and rear attachment tabs are attached to said respective front and rear carton wall panels such that, when said carton blank is folded along said carton bottom front and rear score lines to erect said front and rear carton wall panels and to form an erected carton, said front and rear insert wall panels are caused to be erected inwardly of said erected front and rear carton wall panels to enclose a lateral portion of the space intermediate said erected front and rear carton wall panels.

15. The combination of the carton blank and the insert blank of claim 14 wherein said insert bottom front and rear score lines, said front and rear top score lines, and said front and rear spacer score lines are perforated.

16. The combination of the carton blank and the insert blank of claim 14 wherein said front and rear attachment tabs are adhesively attached, respectively, to said front and rear carton wall panels.

17. The combination of the carton blank and the insert blank of claim 16 wherein said insert bottom panel is adhesively attached to said carton bottom panel.

18. The combination of the carton blank and the insert blank of claim 14 wherein said insert bottom front and rear score lines are parallel to and equidistant, respectively, from said carton bottom front and rear score lines.

19. The combination of the carton blank and the insert blank of claim 18 wherein:

said front and rear top score lines are substantially parallel to said insert bottom front score line;

said front and rear spacer margins are linear, and substantially parallel to said insert bottom front score line;

said first insert bottom side, said first insert front side, said first front spacer side, said first front attachment tab side, said first insert rear side, said first rear spacer side, and said first rear attachment tab side are colinear, and perpendicular to said insert bottom front score line; and said second insert bottom side, said second insert front side, said second front spacer side, said second front attachment tab side, said second insert rear side, said second rear spacer side, and said second rear attachment tab side are colinear, and perpendicular to said insert bottom front score line.

20. A cigarette carton blank having parts thereof defining a carton bottom panel, opposing front and rear carton wall panels, top wall elements and right and left end wall elements;

said carton bottom panel defined by a carton bottom front score line, a carton bottom rear score line parallel to said carton bottom front score line, and first and second carton bottom sides perpendicularly extending between said carton bottom front and rear score lines;

said front carton wall panel connected to said carton bottom front score line, and further defined by a front top margin parallel to said carton bottom front score line and first and second carton front sides perpendicularly extending between said carton bottom front score line and said front top margin; and said rear carton wall panel connected to said carton bottom rear score line, and further defined by a rear top margin parallel to said carton bottom rear score line and first and second carton rear sides perpendicularly extending between said carton bottom rear score line and said rear top margin, the combination with said carton blank of an insert blank having parts thereof defining an insert bottom panel, opposing front and rear insert wall panels, front and rear spacers, and front and rear attachment tabs;

said insert bottom panel defined by:

an insert bottom front score line;

an insert bottom rear score line parallel to said insert bottom front score line, the separation between said insert bottom front and rear score lines being less than the separation between said carton bottom front and rear score lines; and first and second insert bottom sides perpendicularly extending between said insert bottom front and rear score lines;

said front insert wall panel connected to said insert bottom panel at said insert bottom front score line, and further defined by:

a front top score line parallel to said insert bottom front score line;

a first insert front side perpendicularly extending between said insert bottom front score line and said front top score line and colinear with said first insert bottom side; and a second insert front side perpendicularly extending between said insert bottom front score line and said front top score line and colinear with said second insert bottom side;

said front spacer connected to said front insert wall panel at said front top score line, and further defined by:

a front spacer score line parallel to said front top score line;

a first front spacer side perpendicularly extending between said front top score line and said front spacer score line and colinear with said first insert front side; and a second front spacer side perpendicularly extending between said front top score line and said front spacer score line and colinear with said second insert front side;

said front attachment tab connected to said front spacer at said front spacer score line, and further defined by:

a linear front margin parallel to said front spacer score line;

a first front attachment tab side perpendicularly extending between said front spacer score line and said front margin and colinear with said first front spacer side; and a second front attachment tab side perpendicularly extending between said front spacer score line and said front margin and colinear with said second front spacer side;

said rear insert wall panel connected to said insert bottom panel at said insert bottom rear score line, and further defined by:

a rear top score line parallel to said insert bottom rear score line;

a first insert rear side perpendicularly extending between said insert bottom rear score line and said rear top score line, colinear with said first insert bottom side, and equal in length to said first insert front side; and a second insert rear side perpendicularly extending between said insert bottom rear score line and said rear top score line and colinear with said second insert bottom side;

said rear spacer connected to said rear insert wall panel at said rear top score line, and further defined by:

a rear spacer score line parallel to said rear top score line;

a first rear spacer side perpendicularly extending between said rear top score line and said rear spacer score line, colinear with said first insert rear side, and equal in length to said first front spacer side; and a second rear spacer side perpendicularly extending between said rear top score line and said rear spacer score line and colinear with said second insert rear side; and said rear attachment tab connected to said rear spacer at said rear spacer score line, and further defined by:

a linear rear margin parallel to said rear spacer score line;

a first rear attachment tab side perpendicularly extending between said rear spacer score line and said rear margin, colinear with said first rear spacer side, and equal in length to said first front attachment tab side; and a second rear attachment tab side perpendicularly extending between said rear spacer score line and said rear margin and colinear with said second rear spacer side, wherein, prior to folding said carton blank along said carton bottom front and rear score lines to form an erected carton;

said insert bottom front is adhesively attached to said carton bottom panel, with said insert bottom front and rear score lines parallel to said carton bottom front and rear score lines and equidistant, respectively, from said carton bottom front and rear score lines; and said front and rear attachment tabs are adhesively attached, respectively, to said front and rear carton walls, such that, when said carton blank is folded along said carton bottom front and rear score lines to erect said front and rear carton wall panels and to form an erected carton, said front and rear insert wall panels are caused to be erected inwardly of said erected front and rear carton wall panels to enclose a lateral portion of the space intermediate said erected front and rear carton wall panels.

21. The combination of the carton blank and the insert blank of claim 20 wherein said insert bottom front and rear score lines, said front and rear top score lines, and said front and rear spacer score lines are perforated.

22. The combination of the carton blank and the insert blank of claim 20 wherein said blanks are folded to form an erected carton and insert.

* * * * *